US005263910A

United States Patent [19]

Yang

[11] Patent Number: 5,263,910

[45] Date of Patent: Nov. 23, 1993

[54] STEPPING EXERCISER

[76] Inventor: Li-Hsiang Yang, 22-3, Hao Chin Road, San Shen Village, Pu Yuan Hsiang, Changhua, Taiwan

[21] Appl. No.: 9,233

[22] Filed: Jan. 26, 1993

[51] Int. Cl.[5] ..... A63B 22/04

[52] U.S. Cl. ..... 482/52; 482/80

[58] Field of Search ..... 482/51, 52, 53, 79, 482/80

[56] References Cited

U.S. PATENT DOCUMENTS

| | | | |
|---|---|---|---|
| 3,295,847 | 1/1967 | Matt | 482/80 |
| 3,421,760 | 1/1969 | Freeman | 482/80 |
| 4,371,160 | 2/1983 | Shooltz | 482/80 |
| 4,422,635 | 12/1983 | Herod et al. | 482/80 |

*Primary Examiner*—Stephen R. Crow
*Attorney, Agent, or Firm*—Thomas R. Vigil

[57] ABSTRACT

Disclosed is a stepping exerciser for exercising the muscles of the legs. The stepping exerciser comprises two parallel pedals respectively pivoted to two opposite supports on a base frame and supported on the two opposite ends of a rocker arm for stepping the legs up and down alternatively, which rocker arm being balanced on a support at its center and caused to move in seesaw fashion, springs respectively supported between the base frame and the free end of either pedal, and two elastic cords respectively and bilaterally connected to the base frame at one end for pulling with the hands in keeping the body balanced as the user is alternatively stepping on the pedals.

3 Claims, 4 Drawing Sheets

STEPPING EXERCISER

BACKGROUND OF THE INVENTION

1. Field of the Invention

The present invention relates to stepping exercisers for exercising the muscles of the legs. More particularly, the present invention relates to a stepping exerciser which comprises a rocker arm supported between the pedals at the bottom and caused to move in seesaw fashion, and two elastic cords for pulling with the hands in keeping the body balanced as the user is alternatively stepping on the pedals.

2. Description of Prior Art

Various stepping exercisers are known, and widely used for training the muscles of the legs. FIG. 1 illustrates a lightweight stepping exerciser according to the prior art, which is generally comprised of a base frame A1, a rocker arm A3 transversely supported above the base frame A1 and having two rollers A4 on two slots A31 on two opposite ends thereof, two pedals A2 bilaterally pivoted to two supports on the base frame A1 at one end and respectively supported on either roller A4, and two standing handles A5,A6 bilaterally and vertically disposed in front of the pedals A2. When in use, the handles A5,A6 are held with the hands, and then the pedals A2 are alternatively stepped up and down. One disadvantage of this structure of stepping exerciser is that the rollers A4 may be damaged easily during the movement of the rocker arm A3. Another disadvantage of this structure of stepping exerciser is its complicated manufacturing process. Still another disadvantage of this structure of stepping exerciser is that the user may suffer from stiffness of the hands easily while stepping on the pedals A2 with the hands held on the standing handles A5,A6.

SUMMARY OF THE INVENTION

The present invention eliminates the aforesaid disadvantages. According to one aspect of the present invention, the stepping exerciser comprises parallel pedals pivoted to two opposite supports on a base frame and supported on two opposite ends of a rocker arm, two arched wear blocks mounted on the rocker arm at two opposite locations and respectively stopped against either pedal at the bottom, two springs respectively supported between the base frame and the free end of either pedal, and two cords respectively and bilaterally connected to the base frame at one end for pulling with the hands in keeping the body balanced as the user is alternatively stepping on the pedals.

According to another aspect of the present invention, each arched wear block is respectively made from a wear resisting material, having two bottom pins respectively fitted in pin holes on either end of the rocker arm.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 1:
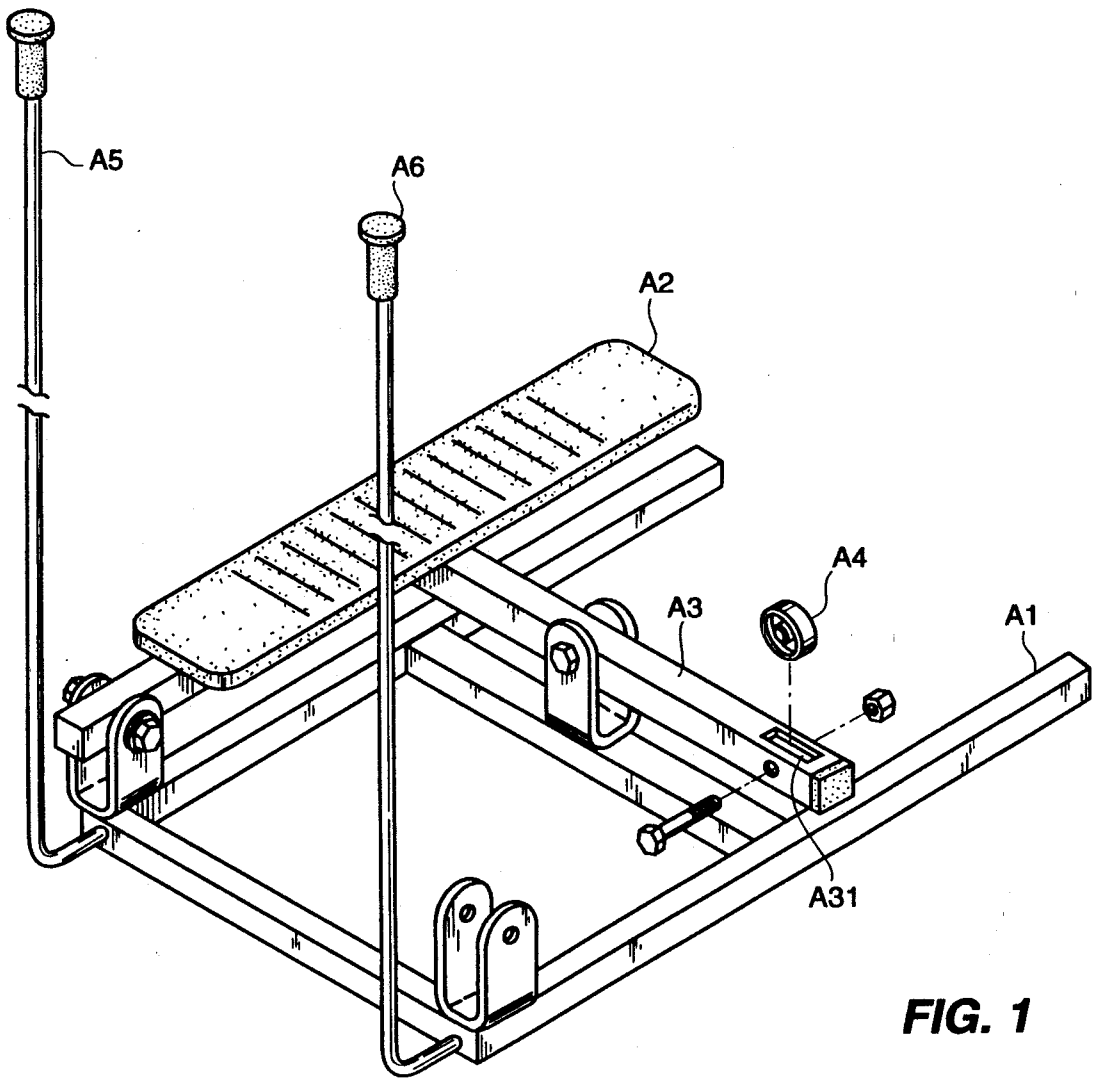
FIG. 1 illustrates a structure of stepping exerciser according to the prior art.
Figure 2:
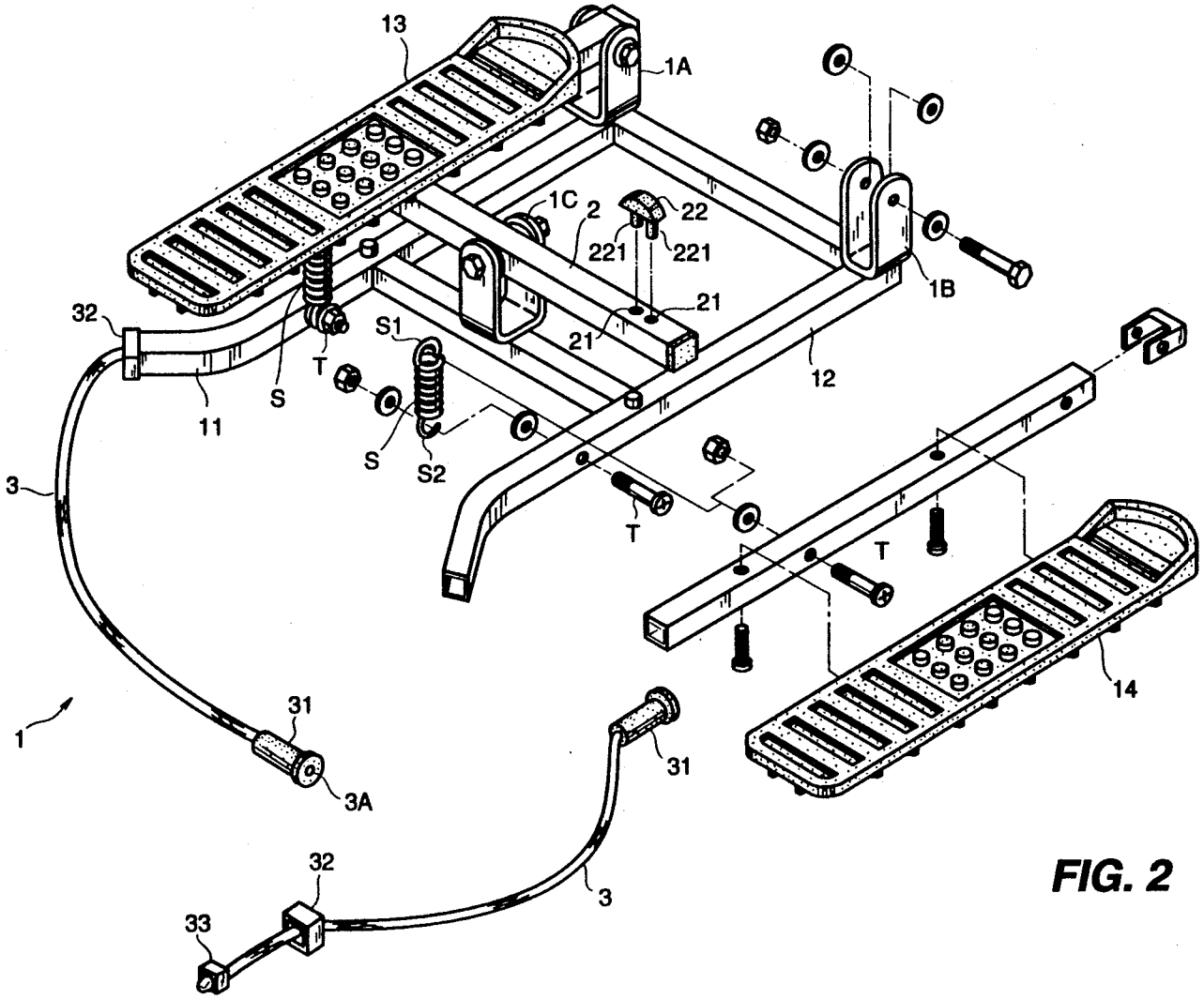
FIG. 2 is a perspective and partial exploded view of a stepping exerciser according to the present invention.

Referring to FIG. 2, a stepping exerciser in accordance with the present invention is generally comprised of a base 1, a rocker arm 2, two pedals 13, 14, and two elastic cords 3.

Figure 3:
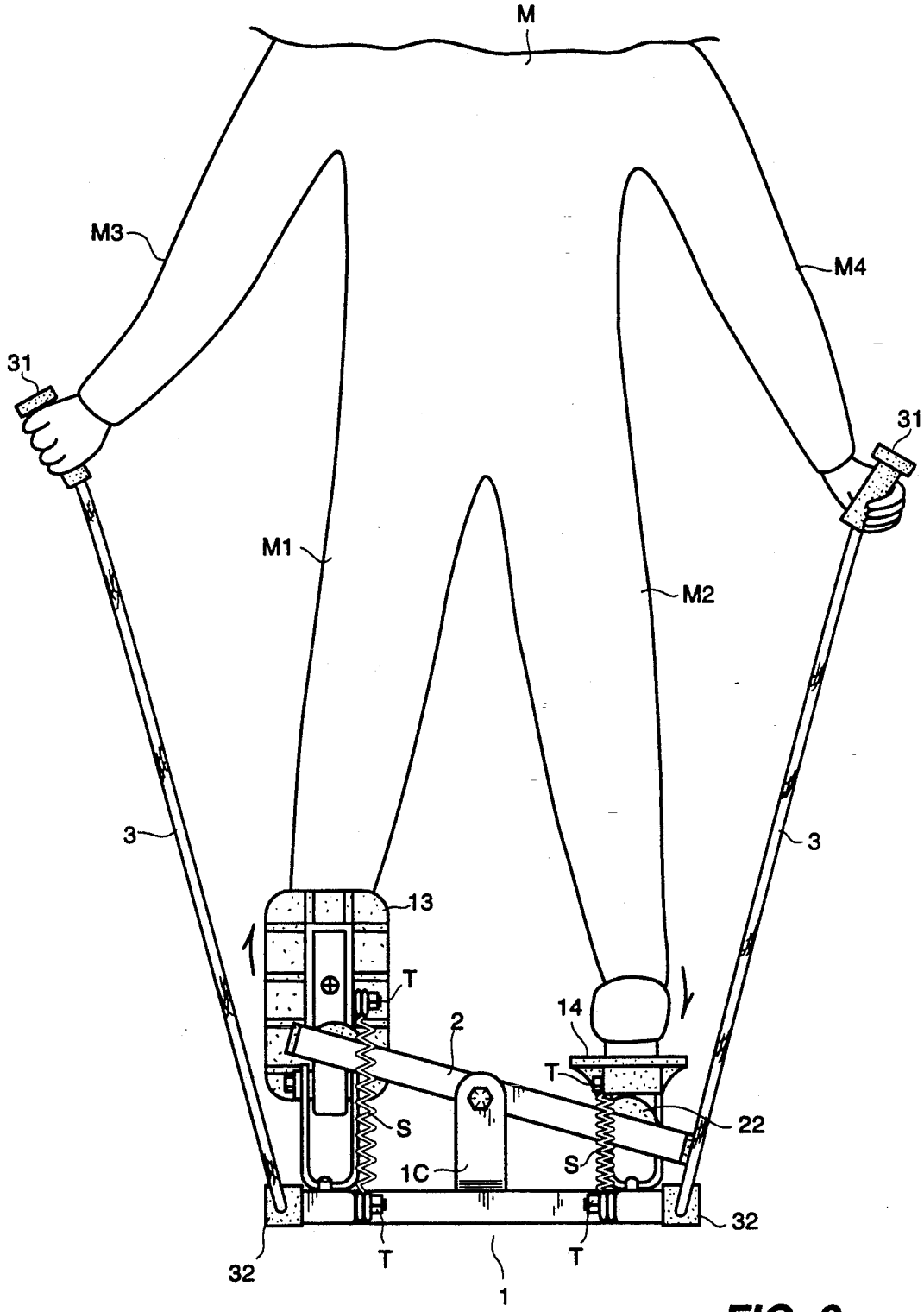
FIG. 3 is an end view showing the pedals alternatively moved up and down.

Referring to FIG. 3 and FIG. 2 again, the base 1 comprises two opposite side frames 11,12, which have each a rear end respectively curved outwards to hold an elastic cord 3, two front supports 1A,1B on two opposite front corners thereof, to which the pedals 13,14 are respectively pivoted, and an intermediate support 1C spaced from the front supports 1A,1B in the middle, on which the rocker arm 2 is supported. The elastic cord 3 has one end coupled with a handle 31 fastened with an ornament ring 3A, and an opposite end inserted through a cap 32, which covers on the curved front end of either side frame 11 or 12, and tied to a locating element 33 fastened inside either side frame 11 or 12. The rocker arm 2 is balanced on the intermediate support 1C at its center, having two arched wear blocks 22 mounted on two opposite ends thereof at the top to support the pedals 13,14 respectively. The arched wear block 22 has two bottom pins 221 fitted into two pin holes 21 on either end of the rocker arm 2. The pedal 13 or 14 has a front end pivoted to either front support 1A or 1B, a rear end supported above either side frame 11 or 12 by a respective spring S. The bottom center of the pedal 13 or 14 is supported on the arched wear block 22 on either end of the rocker arm 2. The spring S has one end S1 hooked on a bolt T on the bottom of either pedal 13 or 14, and an opposite end S2 hooked on a bolt T on either side frame 11 or 12.

Figure 4:
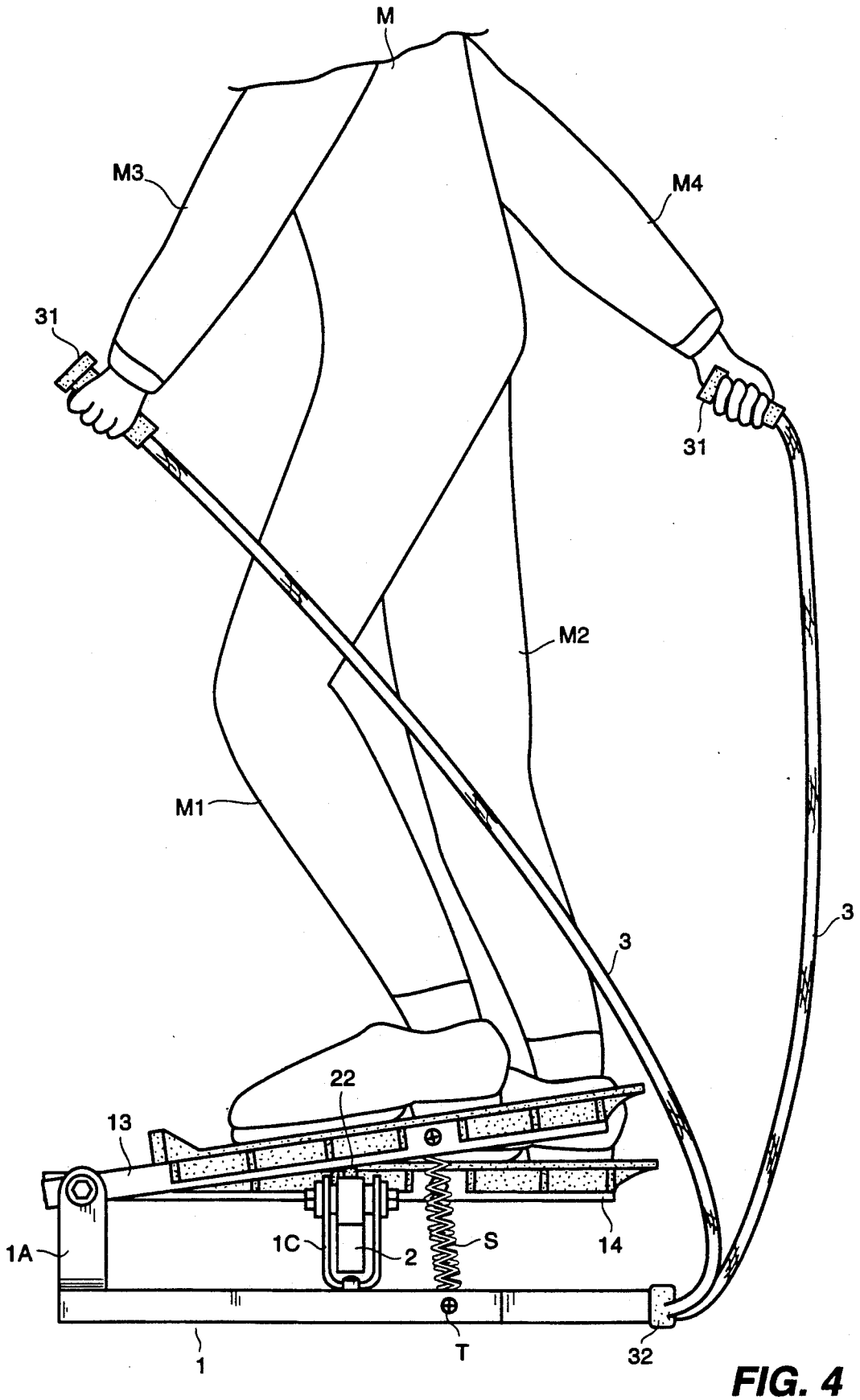
FIG. 4 is a side view showing the elastic cords pulled in different directions.

Referring to FIG. 4 and FIG. 3 again, the operation of the present invention is outlined hereinafter. The handle 31 of the elastic cord 3 is respectively held with either hand M3 or M4 as the user M stands on the pedals 13,14. Pressing the right leg M2 causes the right-hand pedal 14 to move downwards. As the pedals 13,14 are supported on the rocker arm 2 at two opposite ends, moving the right-hand pedal 14 downwards causes the rocker arm 2 to lift the left-hand pedal 13. As the rocker arm 2 is caused to move in seesaw fashion, the pedal 13 or 14 is alternatively moved back and forth along the curved top surface of the respective arched wear block 22. As the pedal 13 or 14 is being moved back and forth alternatively, the respective spring S is also alternatively compressed. Therefore, the pedal 13 or 14 is stably supported by the respective spring S as it is being moved back and forth alternatively.

While stepping on the pedals 13,14 with the elastic cords 3 held with the hands M3,M4, the user M can keep the body balanced by pulling the elastic cords 3 in different directions or releasing them.

What is claimed is:

1. A stepping exerciser comprising two parallel pedals pivoted at one end to two opposite supports on a base frame and medially supported on two opposite ends of a pivotal rocker arm for stepping the legs up and down alternatively, the improvement comprising two arched wear blocks mounted on said rocker arm and respectively stopped against each pedal bottom, spring means respectively supported between said base frame and the other end of either pedal, and two cords respectively and bilaterally connected to said base frame at one end for pulling with the hands in keeping the body balanced as the user is alternatively stepping on said pedals.

2. The stepping exerciser of claim 1 wherein said cords are elastic.

3. The stepping exerciser of claim 1 wherein each arched wear block is respectively made from a wear resisting material, having two bottom pins respectively fitted in pin holes on either end of the rocker arm.

* * * * *